United States Patent [19]

Streit et al.

[11] Patent Number: 4,654,043

[45] Date of Patent: Mar. 31, 1987

[54] DESIZING COTTON AND COTTON-CONTAINING FABRICS

[75] Inventors: Werner Streit, Bobenheim; Linda Witt, Mannheim; Heinz-Dieter Angstmann, Ludwigshafen; Rolf Blanckenhorn, Ludwigshafen; Rolf Fikentscher, Ludwigshafen, all of Fed. Rep. of Germany

[73] Assignee: Basf Aktiengesellschaft, Rheinland-Pfalz, Fed. Rep. of Germany

[21] Appl. No.: 690,522

[22] Filed: Jan. 11, 1985

[30] Foreign Application Priority Data

Jan. 13, 1984 [DE] Fed. Rep. of Germany ..... 3400989

[51] Int. Cl.[4] ..... D06M 13/34; A01N 3/00

[52] U.S. Cl. ..... 8/189; 8/108 A; 8/190; 8/192; 8/195; 8/196; 252/187.24; 252/187.25; 252/187.26

[58] Field of Search ..... 8/108 A, 181, 108 R; 252/98, 252/186.38, 186.39, 186.41, 8/189, 190, 195, 196, 252/187.24, 187.25, 187.26

[56] References Cited

U.S. PATENT DOCUMENTS 3,332,882 7/1967 Blumbergs ..... 252/186

*Primary Examiner*—Paul Lieberman
*Assistant Examiner*—John F. McNally
*Attorney, Agent, or Firm*—Oblon, Fisher, Spivak, McClelland & Maier

[57] ABSTRACT

Cotton and cotton-containing fabrics are desized in strongly alkaline aqueous solution with an alkali metal hypochlorite by a process in which from 0.5 to 8.0 g/l of a tertiary hydroxyalkylamine which is soluble in aqueous alkaline solution, of an oxyethylated and/or oxypropylated ethylenediamine, of an oxyethylated polyethyleneimine, of malonic acid, of cyanuric acid, of a cyanuric acid derivative, of a urea derivative, of cyanoguanidine, of oxazolidone, of pyrrolidone, of N-methylpyrrolidone, of N-methylimidazole or of a mixture of these is added to the aqueous bath, as an activator for the hypochlorite. Activators for hypochlorite are used in the desizing of cotton and cotton-containing fabrics in strongly alkaline aqueous solutions.

5 Claims, No Drawings

DESIZING COTTON AND COTTON-CONTAINING FABRICS

The present invention relates to a process for desizing cotton or cotton-containing fabrics in strongly alkaline solutions with an alkali metal hypochlorite in the presence of an activator for the hypochlorite, and the use of such acitvators for desizing in stronly alkaline aqueous solutions.

In order to be able to weave cotton fabrics and cotton/polyester blends without difficulty, the warp threads are sized. In practice, starch-containing sizing agents are generally used, these frequently also being mixed with semi-synthetic sizing agents, such as carboxymethylcellulose, and synthetic sizing agents, e.g. polyvinyl alcohol or polyacrylates. The fabric is desized by degrading the starch and then washing out the degradation products. The starch can be degraded, for example, enzymatically, or oxidatively with a persulfate or a bromite in an alkaline medium or a medium rendered alkaline with sodium carbonate.

The oxidative desizing of cotton and cotton-containing fabrics in the presence of a hypochlorite in alkaline solutions is known in principle. The disadvantage of this process is that the degradation of natural starch with hypochlorite solutions cannot be carried out at room temperature (cf. K. Frinken, Textilbetrieb, 1974, 92 (4), pages 47–49, in particular page 47, left-hand column, first paragraph), and increasing fiber damage results at elevated temperatures.

Moreover, it is known that hypochlorite can be used to bleach desized fabric. In this bleaching process, the pH is kept as a rule at from 11 to 12; in order to avoid fiber damage in this pH range, in which the hypochlorite exhibits pH-dependent activity, the residence time has to be kept very short.

For this reason, there is to date no satisfactory industrial desizing process which employs an alkali metal hypochlorite.

We have found a process for desizing cotton and cotton-containing fabrics in strongly alkaline aqueous solution with an alkali metal hypochlorite, wherein from 0.5 to 8.0 g/l of a tertiary hydroxyalkylamine which is soluble in aqueous alkaline solution, of an oxyethylated and/or oxypropylated ethylenediamine, of an oxyethylated polyethyleneimine, of cyanuric acid, of cyanoguanidine, of oxazolidone, of pyrrolidone, of N-methylpyrrolidone or of N-methylimidazole is added to the aqueous bath, as an activator for the hypochlorite.

The novel desizing process is carried out at a strongly alkaline pH, corresponding to a content of from 15 to 150, preferably from 25 to 70, g of sodium hydroxide per liter of water, and at room temperature, advantageously at from 10° to 55° C., using an amount of alkali metal hypochlorite, in particular sodium hypochlorite, which corresponds to from 2 to 8, preferably from 2 to 4, g of active chlorine.

The residence time is from 2 to 24 hours and depends of course on the temperature and the amount of active chlorine used. The novel desizing process advantageously also produces a bleaching effect.

For the purposes of the present invention, cotton-containing fabrics are blends containing not less than 30% of cotton, in particular cotton with polyesters.

Specific examples of suitable activators which are used according to the invention and are soluble in the strongly alkaline aqueous solution are tertiary trishydroxyalkylamines where alkyl is of 2 or 3 carbon atoms, such as triethanolamine, bis-hydroxyethyl-hydroxypropylamine or trishydroxypropylamine, oxyethylated and/or oxypropylated ethylenediamines containing a total of from 4 to 10 ethylene oxide and/or propylene oxide units, such as N,N'-tetrahydroxyethylethylenediamine or N,N'-tetrahydroxypropylethylenediamine, urea derivatives, such as N,N'-tetramethyl urea, N,N'-tetrahydroxyethyl urea, N,N'-dimethylethylene urea, N,N'-bishydroxyethylethylene urea, propylene urea, N,N'-dimethylpropylene urea or N,N'-bis-hydroxyethylpropylene urea, oxyethylated polyethyleneimines which contain from 2 to 50 ethyleneimine units and whose imino and amino groups are alkylated with from 1 to 5 ethylene oxide units, e.g. (pentahydroxyethyl)-diethylenetriamine or (hexahydroxyethyl)-tetraethylenepentamine, and cyanuric acid derivatives, such as trishydroxyethyl- and trishydroxypropylmelamine and 2,4,6-trishydroxylamine-triazine.

Particularly preferred activators are cyanuric acid, oxazolid-2-one, N-methylpyrrolid-2-one and N-methylimidazole.

The preferred amounts of activator for the hypochlorite are from 3 to 5 g/l.

The additives according to the invention act in a surprising and unforeseeable manner as activators for the hypochlorite, which is usually deactivated in the strongly alkaline aqueous medium. These additives permit a relatively short residence time for the fabric during the oxidative action of the hypochlorite. The risk of damage to the fabric is substantially reduced. At the same time the fabric is bleached, and residual seed coats from the cotton are for the most part also removed.

Compared with enzymatic desizing, which as a rule is also effected by a dwell method at above 50° C., the novel process can be carried out very effectively at room temperature, i.e. about 20° C., in an energy-saving manner. The bleaching effect and the removal of cotton seed coats without additional heat treatment are the particularly noteworthy advantages compared with the enzymatic desizing method.

In oxidative desizing with persulfates, no significant bleaching effect is obtained when the procedure is carried out by a dwell method at room temperature. Removal of the cotton seed coats is insufficient. In practice, therefore, the oxidative desizing with persulfates is carried out as a heat treatment.

A further advantage which may be mentioned is that when the novel desizing process is used, the treated fabric only requires mild bleaching with hydrogen peroxide in order to achieve pure whiteness, and only about one third to one fourth of the amount of hydrogen peroxide otherwise usually required need be used.

Otherwise, in the novel desizing process, wetting agents, detergents and other conventional assistants, which of course must be stable to hypochlorite, can be added in a conventional manner. The additives are familiar to the skilled worker and serve as a rule to make the course of the desizing process more reliable. This also includes the use of sequestering agents and dispersants when the fabric is being washed.

Because of its low stability (the solutions can only be kept at about 0° C.), hypobromite is not used in industry. Disproportionation of the solutions is moderately fast even at room temperature (Cotton/Wilkinson, Anorganische Chemie, Verlag Chemie, Weinheim 1967, pages 531–534).

EXAMPLES AND COMPARATIVE EXAMPLES

@

The activating effect of the additives on a strongly alkaline hypochlorite solution was determined from the decrease in the active chlorine content of the solutions as a function of time. The particular content of active chlorine was determined titrimetrically with sodium thiosulfate.

TABLE

Activating effect

| Amount of activator added in g/l | | Active chlorine content as a percentage of the initial value after 1 hour | 3 hours | 5 hours | 24 hours |
|---|---|---|---|---|---|
| Without an additive | | 99 | 98 | 95 | 93 |
| Triethanolamine | 1 | 86 | 73 | 65 | 57 |
| Propylene urea | 3 | 20 | 10 | — | — |
| Malonic acid | 5 | 91 | 84 | 76 | 10 |
| Cyanuric acid | 3 | 94 | 91 | 82 | 76 |
| Oxazolidone | 3 | 90 | 73 | 64 | 10 |
| Cyanoguanidine | 5 | 85 | 71 | 54 | 21 |
| 1-Methylpyrrolidone | 3 | 91 | 85 | 80 | 55 |
| 1-Methylimidazole | 3 | 88 | 75 | 70 | 45 |
| $NH—(CH_2—CH_2—NH)_{35}—C_3H_6OH$ $C_3H_6OH$ | 2 | 67 | 48 | 27 | 5 |
| Trishydroxyethyl-melamine | 3 | 54 | 41 | 39 | 38 |
| Trishydroxypropyl-melamine | 3 | 46 | 31 | 29 | 25 |
| 2,4,6-Trishydroxyl-amine-triazine | 3 | 78 | 75 | 70 | 47 |

Test conditions: 20° C., 5 g/l of active chlorine, 40 g/l of NaOH.

The table shows that the residual active chlorine content decreases as the intensity of activation increases.

The alkaline hypochlorite solutions were used for desizing polyester/cotton blends. The specimens were padded with desizing liquor, squeezed off to a liquor pick-up of 100% and allowed a dwell period. After the treatment, all fabrics were washed in the same manner. The whiteness, the extent of desizing (according to the Tegewa scale) and the mean degree of polymerization (DP value) of the cellulose were determined for these specimens.

EXAMPLE 1

Fabric: 65:35 polyester/cotton blend
Size: modified starch
Whiteness of the loomstate goods: 67.8
Seed coats per 100 $cm^2$: 52
DP value: 2190
Compositions of the desizing liquor: 40 g/l of NaOH, 5 g/l of active chlorine, 3 g/l of nonylphenol oxyethylate and 2 g/l of wetting agent (phosphoric acid ester).
Residence temperature: 45° C.

1. A.

| Residence time in hours | Amount of activator added in g/l | Whiteness | Tegewa value | Residual seed coats | DP value |
|---|---|---|---|---|---|
| 3 | Without an additive | 82.9 | 8 | 20 | 1310 |
| | Cyanuric acid 3 | 82.5 | 9 | 23 | 1710 |
| | Cyanuric acid 5 | 82.6 | 9 | 21 | 1750 |
| 5 | Without an additive | 82.8 | 9 | 11 | 1291 |
| | Cyanuric acid 3 | 82.8 | 9 | 13 | 1796 |

-continued

| Residence time in hours | Amount of activator added in g/l | Whiteness | Tegewa value | Residual seed coats | DP value |
|---|---|---|---|---|---|
| | Cyanuric acid 5 | 83.0 | 9 | 10 | 1744 |

1. B.

The fabric was the same as that described in 1.A., and the active chlorine content of the desizing liquor was reduced to 3 g/l.
Residence time: 5 hours
Residence temperature: 45° C.

| Amount of activator added in g/l | Whiteness | Tegewa value | Residual seed coats | DP value |
|---|---|---|---|---|
| Without an additive | 81.9 | 8 | 9 | 1356 |
| Oxazolidone 3 | 81.7 | 9 | 10 | 1796 |
| Oxazolidone 5 | 81.5 | 9 | 12 | 1944 |

The results of 1.A. and 1.B. show that the cotton is substantially damaged in the absence of an activator, and fabrics with such low DP values are normally useless.

EXAMPLE 2

Fabric: Loomstate cotton plain-weave sized with starch; whiteness 56.8; seed coats per 100 $cm^2$: 158; DP value: 2350
Composition of the desizing liquor: 40 g/l of NaOH, 3.2 g/l of active chlorine, 3 g/l of nonylphenol oxyethylate and 1 g/l of wetting agent (phosphoric acid ester).
Residence time: 5 hours
Residence temperature: 45° C.

| Amount of activator added in g/l | Whiteness | Tegewa value | Residual seed coats | DP value |
|---|---|---|---|---|
| Without an additive | 70.1 | 5 | 62 | 1856 |
| Oxazolidone 3 | 67.8 | 6 | 80 | 2296 |
| Oxazolidone 5 | 67.0 | 7 | 78 | 2310 |

The numerical results confirm the particularly high activity of oxazolidone.

For comparison, an experiment was carried out as described in Example 2, but without the addition of hypochlorite and without a catalyst.

| Whiteness | Tegewa value | Residual seed coats | DP value |
|---|---|---|---|
| 63.1 | 4–5 | 110 | 2305 |

The numerical values show that, with regard to whiteness and the removel of seed coats, alkali alone gives unsatisfactory results, so that a stronger peroxide bleach is required.

EXAMPLE 3

Fabric as described in Example 2.

Composition of the desizing liquor: 60 g/l of NaOH, 4 g/l of active chlorine, 3 g/l of nonylphenol oxyethylate and 2 g/l of wetting agent.

Residence time: 16 hours

Residence temperature: 22° C.

| Amount of activator added in g/l | Whiteness | Tegewa value | Residual seed coats | DP value |
|---|---|---|---|---|
| Without an additive | 66.7 | 6–7 | 90 | 2056 |
| 1:1 mixture of triethanolamine and cyanuric acid 2 | 66.5 | 6–7 | 67 | 2191 |

EXAMPLE 4

The fabric and the test conditions employed were as described in Example 3. 2 g/l of a sequestering agent (a carboxyl-containing copolymer) were added in the washing procedure.

| Amount of activator added in g/l | Whiteness | Tegewa value | Residual seed coats | DP value |
|---|---|---|---|---|
| Without an additive | 70.5 | 6–7 | 68 | 2005 |
| 1-Methylpyrrolidone 3 | 71.8 | 6–7 | 72 | 2196 |
| 1-Methylimidazole 3 | 72.4 | 6–7 | 78 | 2104 |

The specimens were then bleached with hydrogen peroxide.

Bleach recipe: 5 g/l of stabilizer, 10 g/l of NaOH, 5 g/l of wetting detergent and 5 ml/l of aqueous 35% strength $H_2O_2$ solution.

Liquor pick-up: 100%

Steaming time: 10 minutes

Bleaching temperature: 100°–102° C.

| Amount of activator added in g/l | Whiteness | Tegewa value | Residual seed coats | DP value |
|---|---|---|---|---|
| Without an additive | 81.7 | 9 | 4 | 1689 |
| 1-Methylpyrrolidone 3 | 82.7 | 9 | 5 | 1847 |
| 1-Methylimidazole 3 | 83.1 | 9 | 3 | 1826 |

The results show that a relatively small amount of hydrogen peroxide is sufficient

EXAMPLE 5

Fabric: 50:50 cotton/polyester poplin shirting

Whiteness: 65.8

Seed coats per 100 $cm^2$: 40

DP value: 3012

Composition of the desizing liquor: 25 g/l of NaOH: 2 g/l of active chlorine, 5 g/l of wetting agent and detergent.

Residence time: 16 hours

Residence temperature: 20° C.

Liquor pick-up: 100%

| Amount of activator added in g/l | Whiteness | Tegewa value | Residual seed coats | DP value |
|---|---|---|---|---|
| Without an additive | 72.7 | 5 | 6 | 2739 |
| Cyanuric acid 3 | 70.2 | 5 | 7 | 2739 |
| Methylpyrrolidone 3 | 70.8 | 5 | 8 | 2830 |

EXAMPLE 6

Fabric: Cotton twill

Whiteness: 55.8

DP value: 2980

Seed coats per 200 $cm^2$: 27

Composition of the desizing liquor: 140 g/l of NaOH, 5 g/l of active chlorine, 3 g/l of detergent and 5 g/l of caustic treatment/wetting agent.

Residence time: 16 hours

Residence temperature: 45° C.

Liquor pick-up: 80%

| Amount of activator added in g/l | Whiteness | Tegewa value | Residual seed coats | DP value |
|---|---|---|---|---|
| Without an additive | 68.1 | 6–7 | 5 | 2314 |
| N—methylpyrrolidone 3 | 66.8 | 6–7 | 4 | 2490 |
| Oxazolidone 3 | 67.1 | 6–7 | 5 | 2510 |

COMPARATIVE EXAMPLE I

The fabric described in Example 4 was desized enzymatically.

Composition of the desizing liquor: 5 g/l of enzymatic desizing agent, 2 g/l of sodium chloride and 3 g/l of nonylphenol oxyethylate.

Residence time: 3 hours

Residence temperature: 75° C.

| Whiteness | Tegewa value | Residual seed coats | DP value |
|---|---|---|---|
| 59.0 | 5–6 | 150 | 2330 |

The fabric was then bleached as described in Example 4, except that four times the amount of hydrogen peroxide was used compared with Example 4.

| Whiteness | Tegewa value | Residual seed coats | DP value |
|---|---|---|---|
| 80.5 | 7 | 34 | 1980 |

When the enzymatically desized fabric was furthermore boiled with 40 g/l of NaOH and 1 g/l of wetting agent for 10 minutes at 100° C. and then bleached using the above recipe (with 20 ml/l of 35% strength $H_2O_2$) the following effect was obtained:

| Whiteness | Tegewa value | Residual seed coats | DP value |
|---|---|---|---|
| 83.0 | 9 | 7 | 1890 |

COMPARATIVE EXAMPLE II

Oxidative desizing with $K_2S_2O_8$.

The fabric from Example 2 or Example 4 was treated with the following desizing liquor: 40 g/l of NaOH, 2 g/l of $K_2S_2O_8$, 5 g/l of wetting agent and detergent, and 2 g/l of sequestering agent.

Residence time: 10 minutes

Residence temperature: 100°–102° C.

Liquor pick-up: 100%.

After the washing procedure, the following effects were measured:

| Whiteness | Tegewa value | Residual seed coats | DP value |
|---|---|---|---|
| 60.3 | 6–7 | 105 | 2120 |

After bleaching with hydrogen peroxide as described in Example I, the following values were measured on the fabric:

| Whiteness | Tegewa value | Residual seed coats | DP value |
|---|---|---|---|
| 81.6 | 9 | 4 | 1810 |

The comparative examples show that, when enzymatic desizing is employed, boiling and stronger peroxide bleaching are required in order to obtain a white fabric free of seed coats. In the case of oxidative desizing with persulfate, too, stronger peroxide bleaching is necessary in order to achieve the same effects.

We claim:

1. A process for desizing cotton and cotton-containing fabrics in a strongly alkaline aqueous solution with an alkali metal hypochorite, wherein from 0.5 to 8.0 g/l of a tertiary trishydroxyalkylamine where alkyl is of 2 or 3 carbons, an oxyethylated or oxypropylated ethylenediamine containing a total of from 4 to 10 aklylene oxide units; an oxyethylated polethyleneimine containing from 2 to 50 ethyleneimine units and whose imino and amino groups are alkylated with from 1 to 5 ethylene oxide units; malonic acid; cyanuric acid; a cyanuric acid derivative, selected from the group consisting of trishydroxyethyl- and trishydroxypropylmelamine and 2, 4, 6-trishydroxylamine-triazine; a urea derivative, selected from the group consisting of propyleneurea, N,N'-dimethylpropyleneurea, N,N'- tetra-methylurea, N,N'-tetrahydroxy ethylurea, N,N'-dimethyl ethyleneurea, and N,N'-bis-hydroxy ethylpropyleneurea; cyanoguanidine; oxazolidone; pyrrolidone; N-methylpyrrolidone; N-methylimidazole and mixtures thereof, which are soluble in aqueous alkaline solution is added to the aqueous bath, as an activator for the hypochlorite.

2. A process as claimed in claim 1, wherein a member selected from the group consisting of cyanuric acid, oxazolid-2-one, N-methylpyrrolid-2-one and N-methylimidazole is added as an activator for the hypochlorite.

3. A process as claimed in claim 1, wherein the activator for the hypochlorite is added to the aqueous bath in an amount of from 3 to 5 g/l.

4. A process as claimed in claim 1 wherein said oxyethylated or oxypropylated ethylenediamine is selected from the group consisting of N,N'-tetrahydroxyethylenediamine and N,N'-tetrahydroxypropylethylenediamine.

5. A process as claimed in claim 1 wherein said tertiary trishydroxzyalkylamine is selected from the group consisting of triethanolamine, bis-hydroxyethylhydroxypropylamine and trishydroxypropylamine.

* * * * *